US007980164B2

(12) United States Patent
Wang

(10) Patent No.: US 7,980,164 B2
(45) Date of Patent: Jul. 19, 2011

(54) MULTI-PURPOSE HOLE PUNCH

(76) Inventor: Shun-Yu Wang, Taipei (TW)

( * ) Notice: Subject to any disclaimer, the term of this patent is extended or adjusted under 35 U.S.C. 154(b) by 0 days.

(21) Appl. No.: 12/003,855

(22) Filed: Jan. 2, 2008

(65) Prior Publication Data

US 2011/0005363 A1 Jan. 13, 2011

(51) Int. Cl.
*B26D 5/08* (2006.01)
*B26F 1/04* (2006.01)

(52) U.S. Cl. ..... 83/549; 83/618; 83/687

(58) Field of Classification Search ..... 83/549, 83/582, 684, 686, 687, 691, 618, 620, 598, 83/599, 601, 583, 584, 588, 589, 552, 571, 83/627, 635

See application file for complete search history.

(56) References Cited

U.S. PATENT DOCUMENTS 440,835 A * 11/1890 Wickman ..... 83/552
1,049,676 A * 1/1913 Cousins et al. ..... 83/549
6,672,191 B2 * 1/2004 Lin ..... 83/549
2002/0002891 A1 * 1/2002 Arnold ..... 83/687
2005/0072286 A1 * 4/2005 Shih ..... 83/549

* cited by examiner

*Primary Examiner* — Stephen Choi
(74) *Attorney, Agent, or Firm* — Muncy, Geissler, Olds & Lowe, PLLC

(57) ABSTRACT

A multi-purpose hole punch, having a main body pivotal configured with a pivot shaft, an upper end of which is pivotal configured with a press plate, and the lower end is connected to a base plate, thereby forming a gap between the main body and the base plate. Each through hole of three sides of the main body has a key-press, and a punch is located in each of the through holes beneath the key-press. Two joined transform plates are pivotal configured on two sides in the gap. One of the transform plates is configured with an unfilled corner able to fixedly position a corner of paper, while the other transform plate forms an unfilled corner able to fixedly position the edge of paper. Accordingly, rotating the press plate and pressing the key-presses above the two unfilled corners enables punching holes in the corner and margin of the paper.

3 Claims, 5 Drawing Sheets

MULTI-PURPOSE HOLE PUNCH

BACKGROUND OF THE INVENTION (a) Field of the Invention

The present invention relates to a multi-purpose hole punch, and more particularly to a hole punch which enables arbitrary adjustment of three sides to provide use modes for punching a hole in the corner of paper or punching a hole in the margin of paper.

(b) Description of the Prior Art

Referring to FIGS. 1 and 2, which show a hole punch of the prior art, comprising a main body 10, a lower portion of which is configured with a L-shaped base plate 11. A perpendicular connecting portion 111 at a rear end of the base plate 11 is connected to a rear end of the main body 10, thereby forming a gap 12 between the main body 10 and the base plate 11 for placing paper 2 therein ready for punching a hole. A through hole is defined in a front end of the main body 10, and a press key 13, an upper end of which protrudes from the through hole, is located at an upper portion of the through hole. A punching pin 14 is disposed within the through hole beneath the press key 13, and a bottom end of the punching pin 14 is fitted with knife edges 141. A spring 15 is mounted on the punching pin 14, and the upper end of the spring 15 abuts against the upper end of the punching pin 14, while the lower end abuts against the inner bottom surface of the main body 10, thereby enabling the press key 13 and the punching pin 14 to use the restoring elasticity of the spring 15 to return to their original positions after being pressed down. Accordingly, the paper 2 requiring a hole to be punched is placed in the gap 12, and the fingers are used to press down on the press key 13 to cause the knife edges 141 of the punching pin 14 to punch a hole in the paper 2.

However, great effort is expended in operating such a hole punch of the prior art, and is only able to punch holes in the margin of the paper 2. Moreover, Indent distance for hole punching (that is, distance from the edge of the paper 2 to the hole punching position) must be adjusted manually, resulting in the inability to punch holes in the corners of the paper 2, as well as punching holes at an inconsistent distance from the paper edge. Hence, the prior art is extremely inconvenient.

SUMMARY OF THE INVENTION

Hence, in light of the shortcomings of the aforementioned hole punch of the prior art, the inventor of the present invention, having accumulated know how and manufacturing experience of diverse hole punch products, attentively researched various methods to resolve such drawbacks, which, following continuous research and improvements, culminated in the design of a completely new and improved hole punch of the present invention.

One objective of the present invention is to provide a multi-purpose hole punch which enables arbitrary adjustment of three sides to provide use modes for punching a hole in the corner of paper or punching a hole in the margin of paper.

According to the aforementioned objective, the hole punch of the present invention is provided with an equilateral triangular main body, a center of which is pivotal configured with a pivot shaft 31 that penetrates the main body, thereby enabling the pivot shaft to rotate in the center of the main body. The upper end of the pivot shaft protrudes from the main body and a press plate is pivotal configured thereon. The lower end of the pivot shaft protrudes from the main body and is connected to a base plate, thereby enabling paper to be inserted into a gap formed between the main body and the base plate ready for punching a hole in the paper. The three sides of the main body are respectively configured with a through hole, and a key-press, the upper end of which protrudes from the through hole, is located in each of the through holes. A punch is located in each of the through holes beneath the key-press, and a spring is mounted on each of the punches, thereby enabling the key-press and the punch to use the restoring elasticity of the spring to return to their original positions after being pressed down. Furthermore, two transform plates are symmetrically located on two sides in the gap, and the two transform plates are joined together and pivotal configured to the pivot shaft, thereby enabling the two transform plates to rotate in the gap. A corner of one of the transform plates is configured with an unfilled corner able to fixedly position a corner of paper, while a corner of the other transform plate forms an unfilled corner able to fixedly position the edge of paper. When in use, the two transform plates are arbitrarily rotated, and the press plate is used to press down on the key-press and the punch above the unfilled corner on which the corner of paper is fixedly positioned, thereby punching a hole in the corner of the paper, and rotating the press plate to the position over the key-press and the punch above the unfilled corner on which the edge of paper is fixedly positioned and pressing down on the press plate enables punching a hole in the margin of the paper.

To enable a further understanding of said objectives and the technological methods of the invention herein, a brief description of the drawings is provided below followed by a detailed description of the preferred embodiments.

DETAILED DESCRIPTION OF THE PREFERRED EMBODIMENTS

Figure 1:
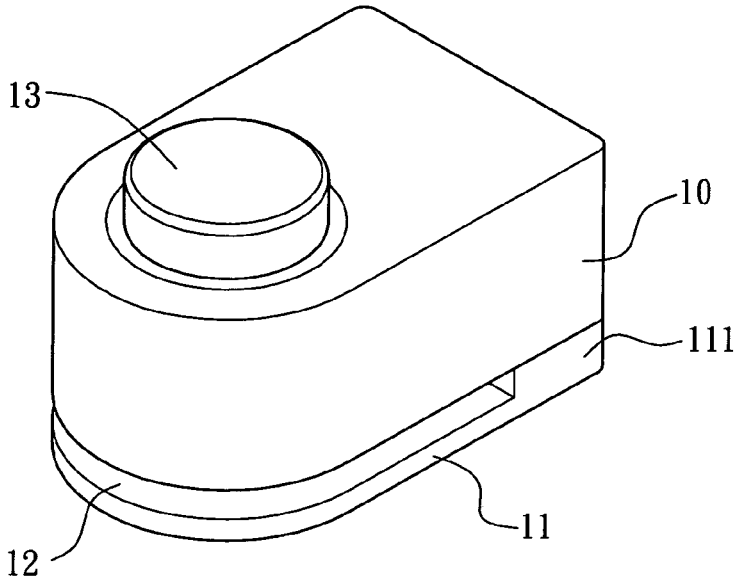
Fig. 1 Prior Art
FIG. 1 shows an external elevational view of a hole punch of the prior art.
Figure 2:
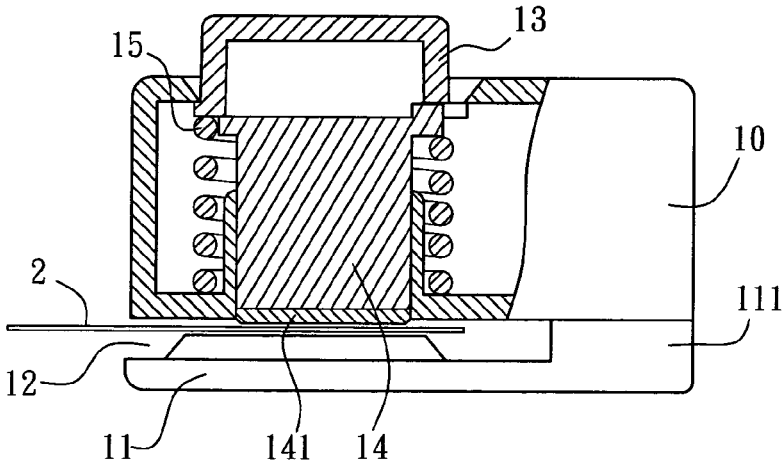
Fig. 2 Prior Art
FIG. 2 shows a schematic cross-sectional view of a hole punch of the prior art.
Figure 3:
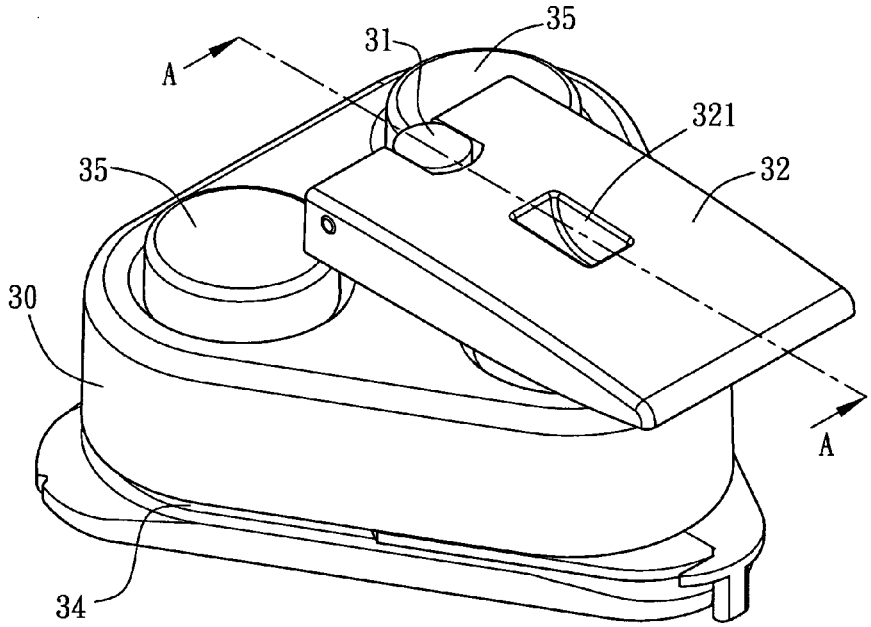
FIG. 3 shows an external elevational view of a hole punch of the present invention.
Figure 4:
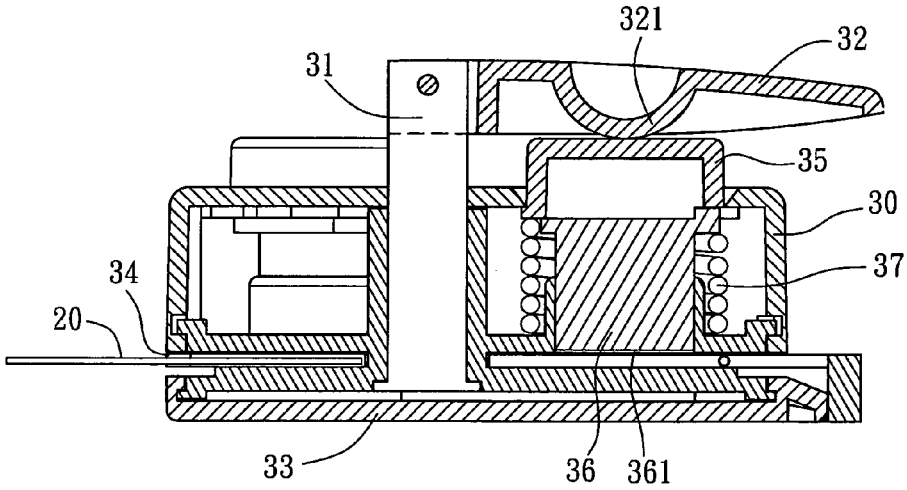
FIG. 4 shows a schematic cross-sectional view of the hole punch of the present invention.
Figure 5:
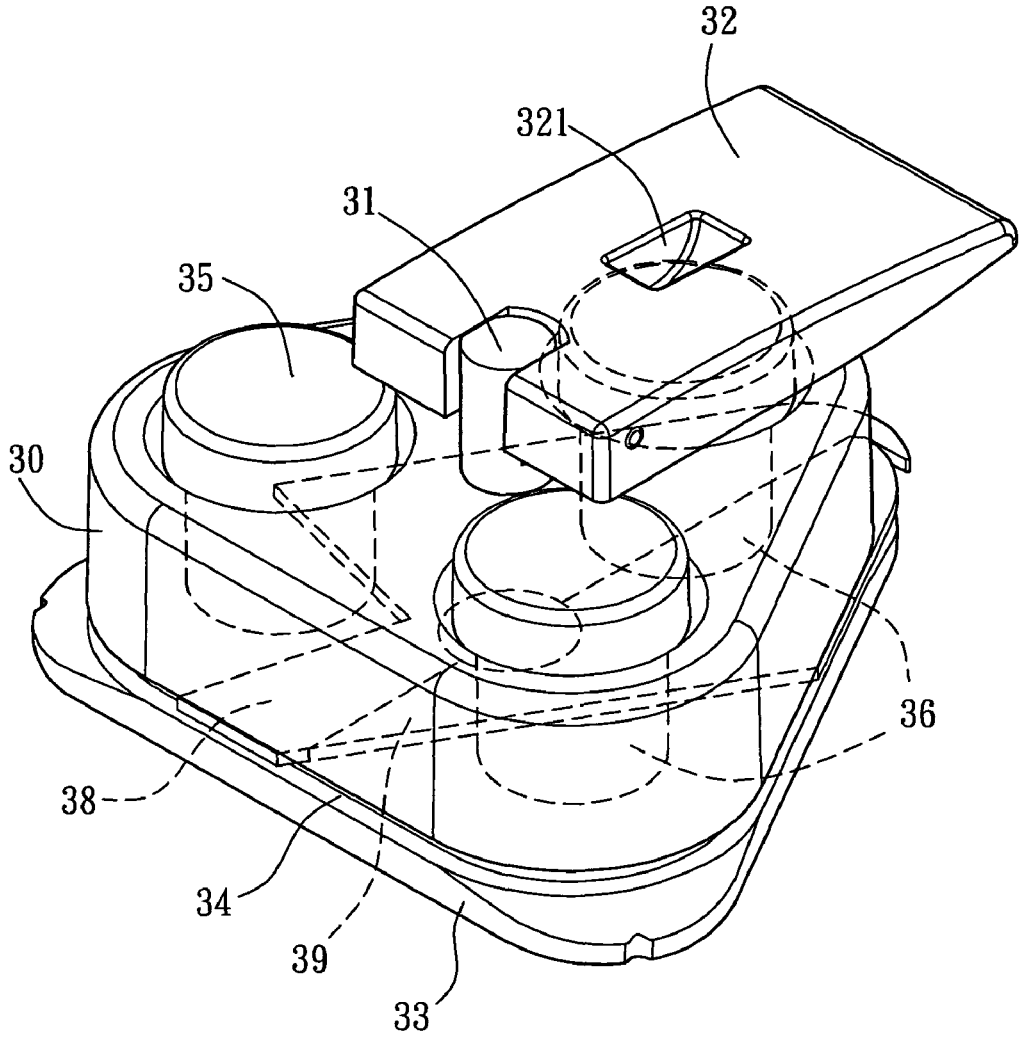
FIG. 5 shows a perspective elevational view of the hole punch of the present invention.
Figure 6:
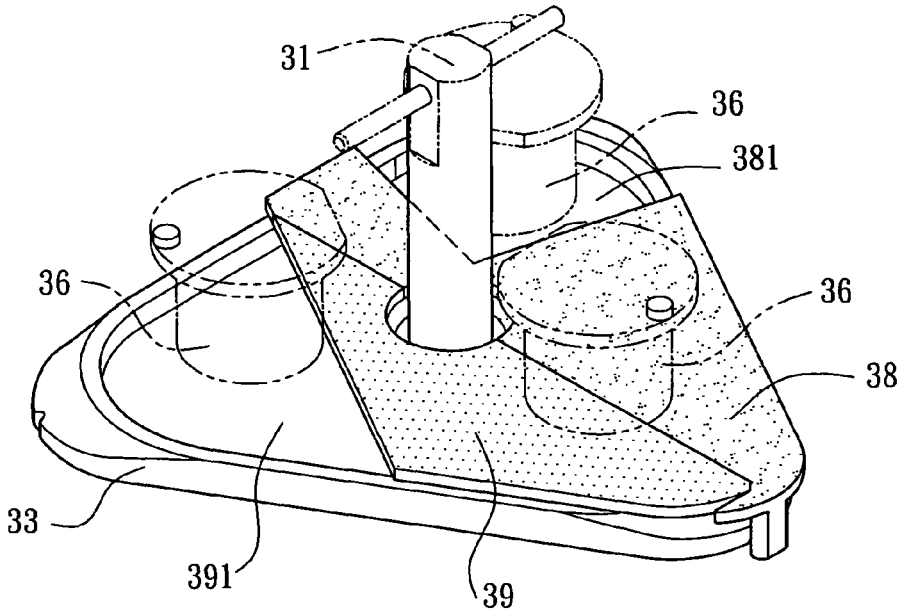
FIG. 6 shows a partial schematic view of the hole punch of the present invention.

The present invention relates to a multi-purpose hole punch. Referring to FIGS. 3, 4, 5 and 6, wherein a hole punch of the present invention is provided with an equilateral triangular main body 30, a center of which is pivotal configured with a pivot shaft 31 that penetrates the main body 30, thereby enabling the pivot shaft 31 to rotate in the center of the main body 30. The upper end of the pivot shaft 31 protrudes from the main body 30 and a press plate 32 is pivotal configured thereon, thereby enabling the press plate 32 to rotate on the upper end of the pivot shaft 31. The lower end of the pivot shaft 31 protrudes from the main body 30 and is connected to a base plate 33, thereby enabling paper 20 to be inserted into a gap 34 formed between the main body 30 and the base plate 33 ready for punching a hole in the paper 20.

The three sides of the main body 30 are respectively configured with a through hole, and a key-press 35, the upper end of which protrudes from the through hole, is located in each of the through holes. A punch 36 is located in each of the through holes beneath the key-press 35, and a knife edge 361 is disposed at the bottom end of the punch 36. A spring 37 is mounted on each of the punches 36, thereby enabling the key-press 35 and the punch 36 to use the restoring elasticity of the spring 37 to return to their original positions after being pressed down.

Two transform plates 38, 39 are symmetrically located on two sides in the gap 34, and the two transform plates 38, 39 are joined together and pivotal configured to the pivot shaft 31, thereby enabling the two transform plates 38, 39 to rotate in the gap 34. A corner of the transform plate 38 is configured with an unfilled corner 381 able to fixedly position a corner (90 degrees) of paper; while a corner of the other transform plate 39 forms an unfilled corner 391 able to fixedly position the edge of paper.

Figure 7:
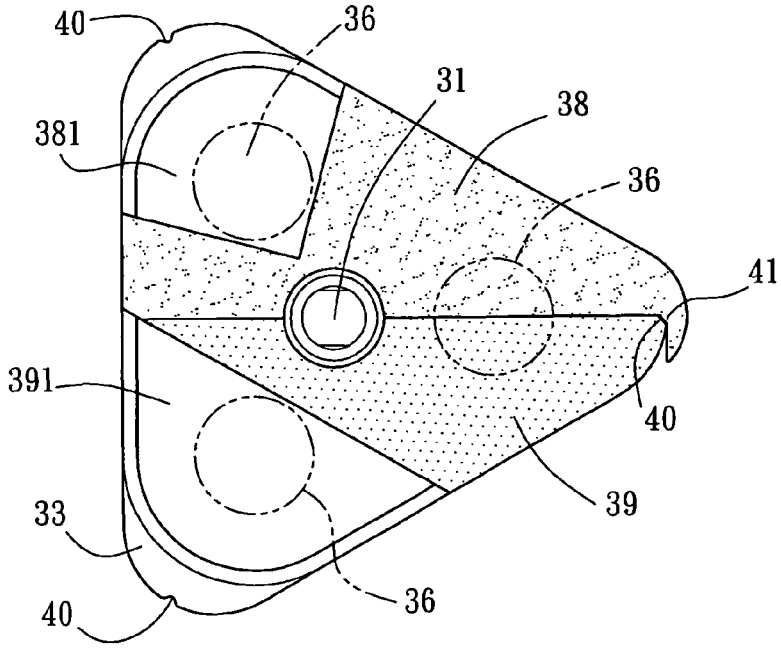
FIG. 7 shows a schematic view 1 depicting how the hole punch can be moved according to the present invention.
Figure 8:
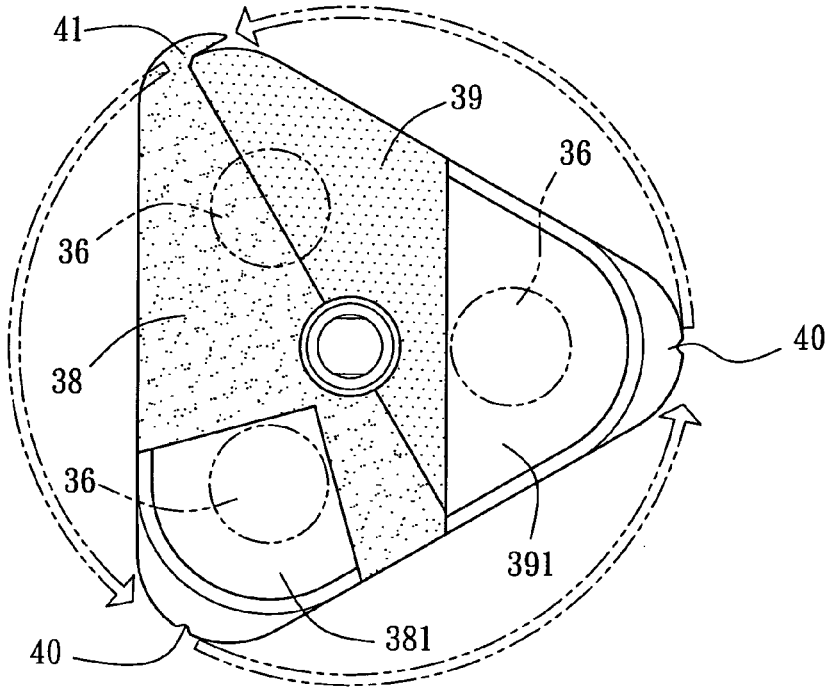
FIG. 8 shows a schematic view 2 depicting how the hole punch can be moved according to the present invention.
Figure 9:
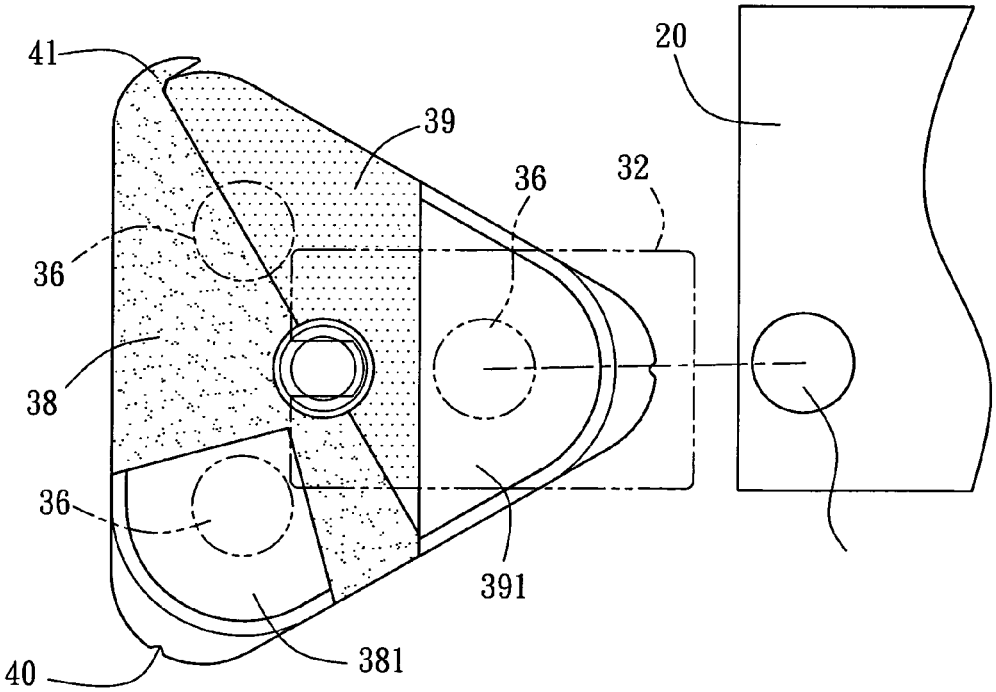
FIG. 9 shows a schematic view 3 depicting how the hole punch can be moved according to the present invention.

According to the assembly of the aforementioned components, and referring to FIGS. 3, 4, 7, 8, and 9, when punching holes, the paper 20 is placed into the gap 34, and the press plate 32 is pressed down to cause the bottom surface of the press plate 32 to press down on the key-presses 35 and the punches 36, thereby causing the knife edge 361 of the punches 36 to punch a hole in the paper 20. In the present invention, the press plate 32 is able to rotate on the upper end of the pivot shaft 31, and is able to press down on any one of the key-presses 35 and the punches 36 of the three sides of the main body 30 for punching a hole therewith. Furthermore, prior to punching a hole, the two transform plates 38, 39 can be arbitrarily rotated, thereby enabling a hole to be punched in the corner of the paper 20 when the press plate 32 is pressed down on the key-press 35 and the punch 36 above the unfilled corner 381 used to fixedly position the paper corner, and by rotating the press plate 32 over the key-press 35 and the punch 36 above the unfilled corner 391 used to fixedly position the paper edge and pressing down on the press plate 32, then a hole can be punched in the margin of the paper 20.

Because the press plate 32 is used to press down on the key-presses 35 and the punches 36, and the front end of the press plate 32 is pivotal configured to the upper end of the pivot shaft 31, thus, such a configuration economizes on effort required to punch a hole compared to the aforementioned hole punch of prior art that requires use of the fingers to directly press down on the key-press 35.

Referring again to FIGS. 3, 4, 5 and 6, an arc-shaped press portion 321 made from tough material is located at the bottom surface of the press plate 32 corresponding to position of each of the key-presses 35, which enables increasing strength and pressing efficiency of the press plate 32.

Referring again to FIGS. 7, 8 and 9, which show a clasp 41 downwardly located on an outer edge of the transform plate 38, and each corner of the base plate 33 is configured with a catch groove 40, thereby enabling the clasp 41 into the corner catch groove 40 when the two transform plates 38, 39 have been rotated into position, and thus causing the two transform plates 38, 39 to be fixedly positioned thereat.

In conclusion, the improved hole punch of the present invention is assuredly provided with an Innovative structure not found in prior art. Moreover, no similar products have been seen in any publication or in the market, the present invention is thus provided with undoubted originality. In addition, the present invention is provided with unique characteristics and functionality that are without comparison in the prior art. Hence, the incomparable advancement of the present invention clearly complies with the essential elements as required for a new patent application. Accordingly, a new patent application is proposed herein.

It is of course to be understood that the embodiments described herein are merely illustrative of the principles of the invention and that a wide variety of modifications thereto may be effected by persons skilled in the art without departing from the spirit and scope of the invention as set forth in the following claims.

What is claimed is:

1. A multi-purpose hole punch, comprising:

an equilateral triangular main body, a center of the equilateral triangular main body is pivotal configured with a pivot shaft that penetrates the main body, thereby enabling the pivot shaft to rotate in the center of the main body, the upper end of the pivot shaft protrudes the main body and a press plate is pivotal configured thereon, thereby enabling the press plate to rotate on the upper end of the pivot shaft, the lower end of the pivot shaft protrudes from the main body and is connected to a base plate, thereby forming a gap between the main body and the base plate which enables paper to be inserted ready for punching a hole therein; the three sides of the main body are respectively configured with a through hole, and a key-press, the upper end of which protrudes from the through hole, is located in each of the through holes;

a punch located in each of the through holes beneath the key-press, and a knife edge is disposed at the bottom end of the punch, a spring is mounted on each of the punches, thereby enabling the key-press and the punch to use the restoring elasticity of the spring to return to their original positions after being pressed down;

two transform plates symmetrically located on two sides in the gap, and the two transform plates are joined together and pivotal configured to the pivot shaft, thereby enabling the two transform plates to rotate in the gap; a corner of one of the transform plates is configured with an unfilled corner able to fixedly position a corner of paper, a corner of the other transform plate forms an unfilled corner able to fixedly position the edge of paper; whereby prior to punching a hole, the two transform plates are arbitrarily rotated, and the press plate is used to press down on the key-press and the punch above the unfilled corner on which the corner of paper is fixedly positioned, thereby punching a hole in the corner of the paper, and rotating the press plate to the position over the key-press and the punch above the unfilled corner on which the edge of paper is fixedly positioned and pressing down on the press plate enables punching a hole in the margin of the paper.

2. The multi-purpose hole punch according to claim 1, wherein an arc-shaped press portion made from tough material is located at the bottom surface of the press plate corresponding to position of each of the key-presses.

3. The multi-purpose hole punch according to claim 1, wherein a clasp is located on an outer edge of one of the transform plates, and each corner of the base plate is configured with a catch groove, thereby enabling the clasp to clasp into the corner catch groove when the two transform plates have been rotated into position, and thus causing the two transform plates to be fixedly positioned thereat.

* * * * *